United States Patent [19]

Hall

[11] Patent Number: 4,640,077

[45] Date of Patent: Feb. 3, 1987

[54] CLIP FOR A SUSPENDED CEILING

[75] Inventor: Stephen Hall, London, England

[73] Assignee: Intalite International N.V., Curacao, Netherlands

[21] Appl. No.: 572,891

[22] Filed: Jan. 23, 1984

[30] Foreign Application Priority Data

| | | | |
|---|---|---|---|
| Jan. 21, 1983 | [GB] | United Kingdom | 8301605 |
| Mar. 17, 1983 | [GB] | United Kingdom | 8307384 |
| Oct. 6, 1983 | [GB] | United Kingdom | 8326733 |

[51] Int. Cl.[4] ..... E04B 5/52

[52] U.S. Cl. ..... 52/665; 52/484; 403/347

[58] Field of Search ..... 52/483, 484, 664–669; 403/346, 347, 405

[56] References Cited

U.S. PATENT DOCUMENTS

| | | | |
|---|---|---|---|
| 2,698,071 | 12/1954 | Lee | 52/484 |
| 3,050,162 | 8/1962 | Zingone | 52/582 |
| 3,139,162 | 6/1964 | Spangenberg | 52/484 |
| 3,193,062 | 7/1965 | Pendleton | 52/483 |
| 3,463,522 | 8/1969 | Meehan | 52/764 |
| 3,588,151 | 6/1971 | Korenz | 403/405 |
| 3,612,461 | 10/1971 | Brown | 52/484 |
| 4,027,446 | 6/1977 | Brugman | 52/665 |
| 4,485,605 | 12/1984 | LaLonde | 52/665 |
| 4,545,165 | 10/1985 | Carey et al. | 52/488 |
| 4,567,698 | 2/1986 | Morrison | 52/36 |

FOREIGN PATENT DOCUMENTS

| | | | |
|---|---|---|---|
| 1420409 | 8/1964 | France . | |
| 2008461 | 1/1970 | France . | |
| 535683 | 1/1978 | Japan | 403/405 |
| 7400362 | 7/1975 | Netherlands . | |
| 802204 | 10/1958 | United Kingdom . | |
| 802205 | 10/1958 | United Kingdom . | |
| 954732 | 4/1964 | United Kingdom | 52/484 |

*Primary Examiner*—John E. Murtagh
*Assistant Examiner*—Andrew Joseph Rudy
*Attorney, Agent, or Firm*—Wenderoth, Lind & Ponack

[57] ABSTRACT

A known grid suspended ceiling has a removable panel. A clip will be captive on a ceiling member at the margin of the opening and will also hold an end of a panel ceiling member securely in position with proper location without requiring a tool for removing the panel. The clip has two securing portions which snap into openings in the margin ceiling member. The clip has jaws connected at their lower ends to wings which can be moved to open the jaws. The jaws have detent portions with horizontal upper surfaces. The panel is merely pushed up into the opening, the detent portion being cammed back and then snapping home into position. To remove the panel, the appropriate wing is pushed, withdrawing the detent portion and allowing the panel to drop down.

12 Claims, 18 Drawing Figures

CLIP FOR A SUSPENDED CEILING

BACKGROUND OF THE INVENTION

There are known suspended ceilings which comprise a grid of elongate ceiling members, for instance Great Britian Pat. No. 1 472 285 describes one such ceiling. In such ceilings, the ceiling members can define one or more openings which are substantially larger than the normal spaces between the ceiling members, and which are closed by removable panels. Such openings can for instance provide access to the space above the ceiling. The panel can also comprise a grid of ceiling members and can be arranged such that the ends of the panel ceiling members butt or nearly butt against the sides of the ceiling members defining the margins of the opening, to provide visual continuity across the panel. In order to secure the panel in position, the ends of at least some of the panel ceiling members can have a detent piece; clips of roughly inverted-U shape are used to secure the ends of respective panel ceiling members to the sides of the margin ceiling members. In detail, each clip has a bridge portion which spans the margin ceiling member, means for limiting the downward movement of the clip with respect to the margin ceiling member (which means may form part of the bridge portion), jaws or retaining portions which extend down the sides of the margin ceiling member, at least the retaining portion on the side facing the panel ceiling member being sprung and passing down behind the detent piece in the end of the panel ceiling member, and a detent portion on the latter retaining portion for entering a detent in the detent piece in the end of the panel ceiling member and retaining the end of the panel ceiling member in position.

It is often specified that the panel should be demountable from below without having to raise the panel above the level of the ceiling. The use of the clips can achieve this, but may give various problems. The clips may not be captive, and can be pushed up off the margin ceiling member when the panel is raised into position. The clips do not necessarily give perfect alignment and if the panel is pushed up too hard in order to obtain alignment, the clip itself may rise or alternatively the panel may push up the surrounding parts of the ceiling and distort the whole ceiling. Lastly, due to a requirement which is frequently made that the panel can be dismounted without using any sort of tool, the detent portion which enters the detent in the end of the panel ceiling member may have an inclined upper surface so that the retaining portion and detent portion can be cammed aside when the panel is pulled down; this leads to difficulty in aligning the lower surface of the panel exactly with the plane of the ceiling; furthermore, small inaccuracies in tolerances can lead to the panel itself being easy to dislodge.

For convenience, the clips are described herein in the orientation they will assume when properly in position on the ceiling. However, it will be appreciated that they may be for instance manufactured, sold or stored in other orientations.

SUMMARY OF THE INVENTION

In one aspect, the invention provides a clip for a suspended ceiling comprising a grid of elongate ceiling members with spaces therebetween, which ceiling members define an opening which is substantially larger than said spaces and is closed by a removable panel, the panel also comprising a grid of elongate ceiling members and being arranged such that the ends of panel ceiling members butt or nearly butt against the sides of ceiling members defining the margins of the opening, the ends of at least one of the panel ceiling members having a detent piece defining a detent and the clip being for securing the end of a panel ceiling member to the side of the margin ceiling member, the clip comprising:

a bridge portion which can span the margin ceiling member;

means for limiting the downward movement of the clip with respect to the margin ceiling member;

retaining portions which can extend down the sides of the margin ceiling member with one retaining portion behind the detent piece in the panel ceiling member, at least the latter retaining portion being sprung;

a detent portion on the latter retaining portion, for entering the detent in the end of the panel ceiling member and retaining the end of the panel ceiling member in position; and a securing portion which can engage under a detent on the margin ceiling member when the clip is pushed down onto the margin ceiling member and can prevent the clip moving up with respect to the margin ceiling member. Preferably, there are slots in the clip which open downwards and are positioned to receive the edges of the sides of the margin ceiling member, located the clip with respect to the margin ceiling member and limit the downward movement of the clip with respect to the margin ceiling member. The securing portion of the clip may be a bent-in projection on a retaining portion, for engaging in a detent formed by a recess or opening in the ceiling member.

The invention also provides, in a second aspect, a clip for a suspended ceiling comprising a grid of elongate ceiling members with spaces therebetween, which ceiling members define an opening which is substantially larger than said spaces and is closed by a removable panel, the panel also comprising a grid of elongate ceiling members and being arranged such that the ends of panel ceiling members butt or nearly butt against the sides of ceiling members defining the margins of the opening, the ends of at least one of the panel ceiling members having a detent piece defining a detent and the clip being for securing the end of a panel ceiling member to the side of the margin ceiling member, the clip comprising:

a bridge portion which can span the margin ceiling member;

means for limiting the downward movement of the clip with respect to the margin ceiling member;

retaining portions which can extend down the sides of the margin ceiling member with one retaining portion behind the detent piece in the panel ceiling member, at least the latter retaining portion being sprung;

a detent portion on the latter retaining portion, for entering the detent in the end of the panel ceiling member and retaining the end of the panel ceiling member in position; and an upwardly-extending release portion connected to said latter retaining portion and arranged such that it can be operated by hand to move the respective retaining portion away from the margin ceiling member and thereby withdraw the detent portion from the detent in the end of the panel ceiling member. Preferably, the latter clip also has a securing portion which can engage under a detent on the margin ceiling member when the clip is pushed down onto the margin ceiling member and can prevent the clip moving up with respect to the margin ceiling member. The release portion may act as a lever, wherein movement of the release portion towards the middle of the margin ceiling member withdraws the detent portion. Also, the release portion may be connected to the bottom end of the retaining portion by an approximately 180° bend.

The invention further provides a suspended ceiling comprising a grid of elongate ceiling members with spaces therebetween, which ceiling members define an opening which is substantially larger than said spaces and is closed by a removable panel, the panel also comprising a grid of ceiling members and being arranged such that the ends of the panel ceiling members butt or nearly butt against the sides of ceiling members defining the margins of the opening, the end of at least one of the panel ceiling members being secured to a margin ceiling member by a clip as described above, the end of the panel ceiling member having a detent piece defining a detent for engagement by the detent portion of the clip.

The invention also provides a method of inserting a panel in a suspended ceiling which comprises a grid of elongate ceiling members with spaces therebetween, which ceiling members define an opening which is substantially larger than said spaces and into which a panel is to be inserted, the panel also comprising a grid of ceiling members and being arranged such that the ends of panel ceiling members will butt or nearly butt against the sides of the ceiling members defining the margins of the opening, the end of at least one of the panel ceiling members having a detent piece defining a detent, the method comprising putting a clip, as described above, over a margin ceiling member so as to engage the panel ceiling member having said detent, and pushing the panel up into the opening so that said latter retaining portion of the clip passes down behind the detent piece in the panel ceiling member and said detent portion on the clip enters the detent in the panel ceiling member and retains the end of the panel ceiling member in position.

The clip of the first aspect of the invention recited above is a captive clip and will remain secured to the margin ceiling member. The detent of the margin ceiling member can be that which is already provided for retaining another elongate ceiling member in position at right angles to the margin ceiling member, on the other side to the panel.

The clip of the second aspect of the invention recited above can be opened to allow the panel to drop down, without requiring any tool. It is merely necessary to actuate the upwardly-extending release portion. Preferably, the upper end of the release portion projects above the plane of the ceiling system, but this is not necessarily so. In order to make operation simpler, or to provide for cases where there is a removable panel on each side of the margin ceiling member, the clip can have such a release portion on each side. The two release portions can be squeezed together with say the thumb and middle finger; alternatively, only one release portion need be pressed if just one panel is to be dropped down.

The use of the release portion enables the detent portion to have a substantially horizontal top surface, thereby providing more precise location of the end of the panel ceiling member and reducing the possibility of accidental release of the panel ceiling member.

The invention is particularly applicable to a suspended ceiling in which the elongate ceiling members are of generally U-shaped cross-section with the bases of the U's at the bottom, though the tops of the U's may be closed by an inwardly-projecting flange on one side of the U. In this case, the respective retaining portion of the clip can be within the end of the panel ceiling member. The detent in the panel ceiling member can be provided by an opening in an end wall of the panel ceiling member which at least partly closes the end.

The clips of the second aspect of the invention particularly described above can have upwardly-extending wings or release portions for opening the jaws of the clip and releasing the panel.

In some circumstances, the clip should not project above, or project far above, the top of the suspended ceiling, for instance if another solid ceiling material is to be laid across the top of the suspended ceiling for acoustic or other purposes, or if a light panel is to be directly above the suspended ceiling.

The release portions of the clip can be omitted if the detent portion is suitably designed to enable the panel to be pulled down or if a suitable tool is used.

In a suitable design of the detent portion, it has its upper surface inclined so that as the panel is pulled down, the detent portion and the retaining portion are cammed out of the way. The force required to pull down the panel can be adjusted by the angling of the detent portion top surface ( b 45° is preferred) and the springiness or thickness of the material of the jaws or retaining portions.

If a tool is being used, the detent portion can continue to have a substantially horizontal top surface. In a preferred arrangement, the retaining portion or jaw has a camming means and the tool has a thin part which is inserted up between the side of the ceiling member and the jaw, to cam back the detent portion. The arrangement may be such that the tool needs to have a special shape to insert it properly; this can be a desirable feature, enabling the removal of panels to be limited to personnel who have the special tools.

BRIEF DESCRIPTION OF THE DRAWINGS

Preferred embodiments of the invention will be further described, by way of example, with reference to the accompanying drawings, in which.

DETAILED DESCRIPTION

Figure 1:
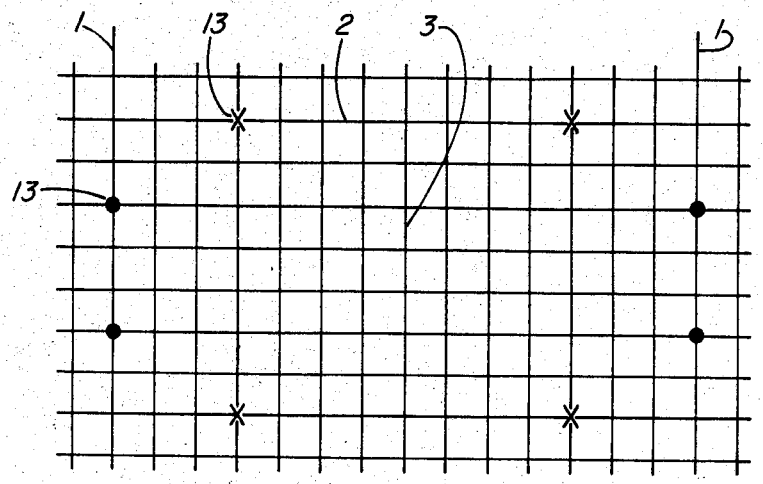
FIG. 1 is a schematic view of the underside of the ceiling system, showing a removable panel.

FIG. 1 shows a portion of the underside of a suspended ceiling formed of a grid of elongate ceiling members (often called "blades"). The ceiling members are of generally U-shaped cross-section with the bases of the U's at the bottom. As specifically shown in FIG. 1, ceiling members in the form of long hanger runners 1 and cross-runners 2 define an opening which is substantially larger than the normal spaces between the ceiling members, and the opening is closed by a removable panel 3, also formed of a grid of ceiling members.

Figure 2:
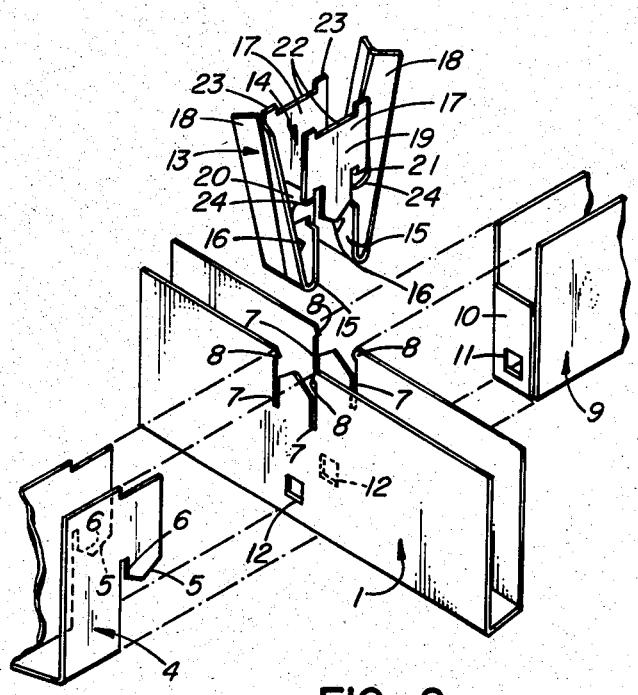
FIG. 2 is an isometric, exploded view, on a large scale, showing where a panel ceiling member joins a margin ceiling member and showing a first clip which is one embodiment of the invention.
Figure 3:
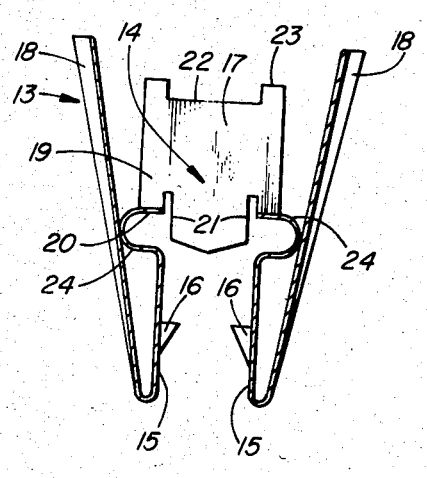
FIG. 3 is an end view of the first clip.

FIGS. 2 and 3

FIG. 2 shows a hanger runner 1 (margin ceiling member) and a ceiling member 4 which is connected thereto by means of a hook 5 which hooks over the hanger runner 1 so that the slots 6, 7 interengage. The member 4 is retained in position by a longitudinally-projecting nib 8 with an angled top surface and a horizontal bottom surface, under which the top edge of the hook 5 snaps.

The end of a panel ceiling member 9 butts against the other side of the hanger runner 1. As can be seen, the end of the panel ceiling member 9 is closed by a detent piece or wall 10 which can be formed by bending in one side or bending in both sides to the center plane. The wall 10 defines a detent recess 11, and like recesses 12 are provided in the hanger runner 1. The panel ceiling member 9 has no projecting parts, and can be withdrawn downwards.

A clip 13 is provided in order to secure the end of the panel ceiling member 9 to the side of the hanger runner 1. The clip 13 is formed from a single piece of sheet material, for instance of stainless steel blade spring material having a thickness of 0.4 mm.

For the purposes of the description, the clip 13 is notionally divided into a number of portions, namely:

a bridge portion 14 which spans the hanger runner 1 and is associated with means for limiting the downward movement of the clip 13 with respect to the hanger runner 1;

identical jaws or retaining portions 15 which extend down either side of the hanger runner 1 and both of which are sprung, one passing down behind the end wall 10 and detent recess 11 of the panel ceiling member 9;

detent portions 16 on each of the jaws 15, for entering the detent recesses 11, 12, 12 as appropriate and retaining the end of the panel ceiling member 9 in position;

two sprung securing portions 17 which snap under the nibs 8 on the hanger runner 1 and prevent the clip 13 moving up with respect to the hanger runner 1; and two identical upwardly-extending wings or release portions 18 which are connected to the respective jaws 15 and are arranged so that they can be squeezed together by hand to move the jaws 15 away from the sides of the hanger runner 1 and withdraw the detent portion 16 from the detent recess 11 in the end of the panel ceiling member 9.

In more detail, it will be seen that the bridge portion 14 is formed by two spaced, parallel, vertical bridge pieces 19 which lie in transverse planes of the hanger runner 1. The bottom part of each side of each bridge piece 19 is connected to the facing part of the other bridge piece 19 by a respective horizontal connecting piece 20. Along their outer edges, the connecting pieces 20 are connected to the upper ends of the jaws 15. The upper parts of the bridge pieces 19 form the securing portions 17. The bridge pieces 19 have slots 21, open downwards, on either side immediately inside said bottom parts or the connecting pieces 20 and extending above said bottom parts. These slots 21 receive the edges of the sides of the hanger runner 1 and engage with the slots 7. In this way, the clip 13 is located transversely with respect to the hanger runner 1 and the downward movement of the clip 13 with respect to the hanger runner 1 is limited. In addition, the relatively thin bottom parts formed on the bridge pieces 19 enable the securing portions 17 to be sprung inwards without great effort as they cam over the nibs 8.

Each securing portion 17 has a notch defined by lower detent edge 22 for engaging under the nibs 8, and upper edges 23, above the level of the retaining edge 22, which are flush with the top of the hanger runner 1.

As the wings 18 are provided, the upper surfaces of the detent portions 16 can be horizontal, the holding portions 16 being formed by pressing out a triangular shape, as shown. The bottom ends of the jaws 15 are connected directly to the wings 18 by means of an approximately 180° bend, and the wings 18 are fluted at an included angle of about 150° to make them stronger. The upper ends of the wings 18 project above the plane of the upper surface of the ceiling system. One wing 18 will project up out of the ceiling member 4, the other up out of the ceiling member 9.

The wings 18 act as levers, crossing over respective protrusions adjacent the tops of the locating portions 15 to form fulcrums; the jaws 15 are connected to the bridge portion 14 by outwardly-protruding bows 24 which form such protrusions; the bows 24 also give an improved spring effect to the jaws 15.

In this way, squeezing the upper end of a wing 18 towards the middle of the hanger runner 1 moves the respective detent portion 16 in the opposite direction.

The clips 13 can be positioned as desired, according to the size and shape of the panel 3. FIG. 1 shows by way of example a panel which is 1200×600 mm, and just four clips 13 are required. The clips can be for instance either at the positions indicated with circles or at the positions indicated with crosses.

Figure 4:
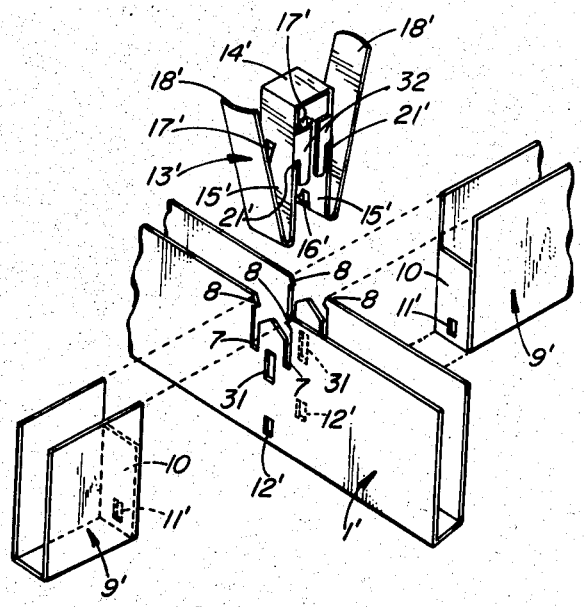
FIGS. 4 and 5 correspond to FIGS. 2 and 3, but show a second clip which is another embodiment of the invention.
Figure 5:
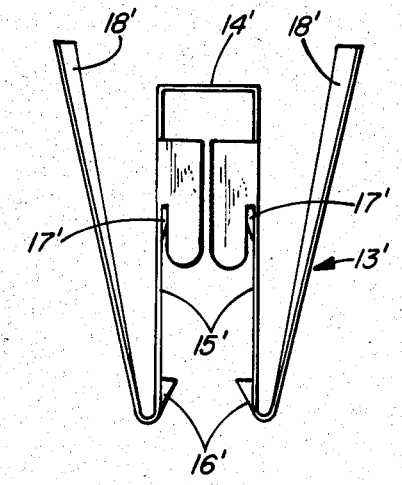

The clip 13 can be designed for any suitable size of ceiling member. Normally, the ceiling members have a depth of 40 mm or 60 mm. FIGS. 4 and 5

In general terms, the clip 13' of FIGS. 4 and 5 is similar to the clip 13 of FIGS. 2 and 3, but the clip 13' has been simplified for manufacture. Identical parts are indicated with identical references and parts that serve the same function and are generally similar are indicated with the same references, but primed.

The bridge portion 14' is simpler and is generally of U-shape, inverted.

The detent portions 16' on the jaws 15' are somewhat lower, and each is in the form of a simple bent-in triangular-shaped tab.

The securing portions 17' are different. Each is in the form of a simple bent-in, triangular-shaped tab which engages in a hole or opening 31 in the marginal member 1', the securing portions 17' snapping into place when the clip 13' is pushed home.

The wings 18' have a curved rather than a fluted section. The wings 18' do not pass over any fulcrum. However, although the whole length of each wing 18' and the whole length of the respective jaw 15' will flex to a certain extent, the jaw 15' tends to flex about the smaller section on either side of the opening for the securing portion 17'. Pressing the top of the wing 18' towards the middle of the hanger runner 1' moves the respective detent portion 16' in the opposite direction.

The slots 21' for receiving the edges of the sides of the hanger runner 1' and engaging with the slots 7 are formed in bent-in tabs 32. The slots 21' still perform the functions of locating the clip 13' transversely and limiting the downward movement of the clip 13' with respect to the hanger runner 1'

To illustrate the possibility of there being another removable panel on the other side of the hanger runner 1', the ceiling member 4 of FIG. 2 is replaced by a panel ceiling member 9' in FIG. 4.

Figure 6:
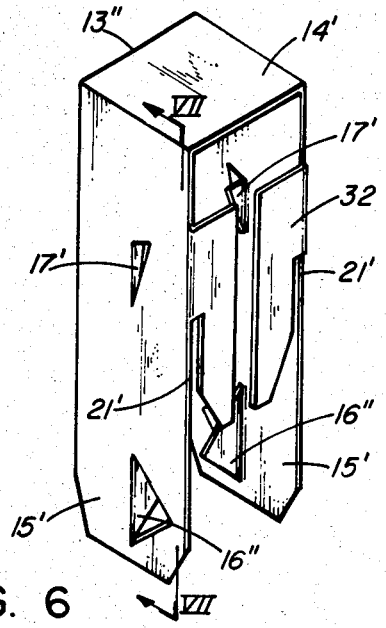
FIG. 6 corresponds generally to FIG. 4, but shows a third clip which is another embodiment of the invention.
Figure 7:
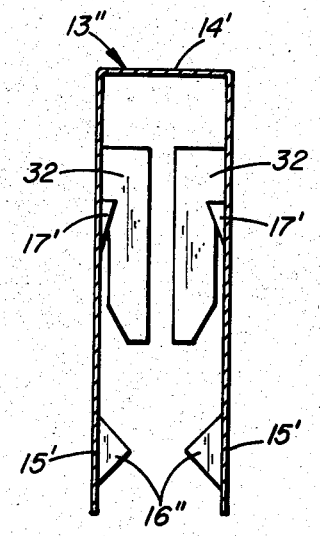
FIG. 7 is a vertical section along the plane VII—VII in FIG. 6.

FIGS. 6 and 7

In general terms, the wings 18' of the clip 13' of FIGS. 4 and 5 have been omitted from the clip 13'' of FIGS. 6 and 7, and the upper surfaces of the detent portions 16'' are inclined downwards and inwards at about 45°. Generally as in FIG. 4, the top of the clips 13'' will be flush with the top of the respective marginal ceiling member 1'. As is also true in the case of the clip 13' of FIG. 4, the nibs 8 on the marginal ceiling member 1' are included for retaining other ceiling members, and are not essential for the clip 13''.

FIG. 8

Figure 8:
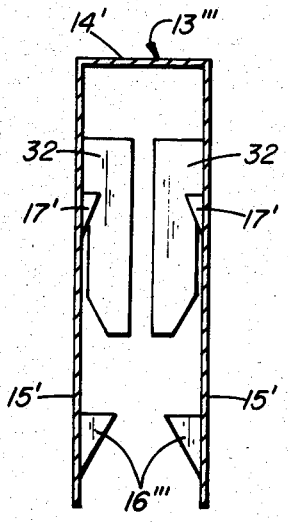
FIG. 8 corresponds generally to FIG. 7, but shows a fourth clip which is another embodiment of the invention.

The clip 13''' of FIG. 8 is very similar to the clip 13'' of FIGS. 6 and 7, but the upper surfaces of the detent portion 16''' are horizontal, generally as in FIGS. 1 to 5. The lower surfaces are inclined downwards and outwards at about 60° to the horizontal, and act as camming means for camming the respective jaw 15' upon insertion of a thin, flat tool between the bottom of the jaw 15' and the side of the marginal ceiling member 1'. The tool can be a plastic card, e.g. 0.5 mm thick, like a credit card; simple instructions could be printed on the card.

Fifth clip

In the fifth clip 13'''', the jaws 15'''' have 45° detent portions 16'''' formed on the inside edges of wings 18'''' on the bottom ends of the jaws 15''''. To accommodate the detent portions 16'''', the detent face or wall 10'''' on the end of the panel ceiling member 9'''' is in the form of a single bent-over tag with a large detent recess 11'''' below. The detent recess 12'''' on the hanger runner 1'''' is correspondingly wide, but does not extend to the base of the hanger runner 1''''. The bottom inside edges 33'''' of the wings 18'''' (at right angles to the detent portions 16'''') act as camming surfaces to open the jaws 15'''' when the clip 13'''' is pushed down onto the hanger runner 1'''' or the panel is inserted up into position.

The bridge portion 14'''' is on the side of the top of the clip 13'''', and the top of the clip 13'''' is provided with inturned upper edges 23'''' so that it is easy to push the clip down onto the hanger runner 1''''. The bridge portion 14'''' has a blade 32'''' which is bent inwards and helps guide the clip 13'''' down into position and also defines the slots 21''''.

The securing portions 17'''' are slightly different to the securing portions 17' shown and in FIG. 4, being bowed outwardly the corresponding holes or openings 31'''' in the hanger runner 1'''' are somewhat wider than those shown in FIG. 4.

Figure 9:
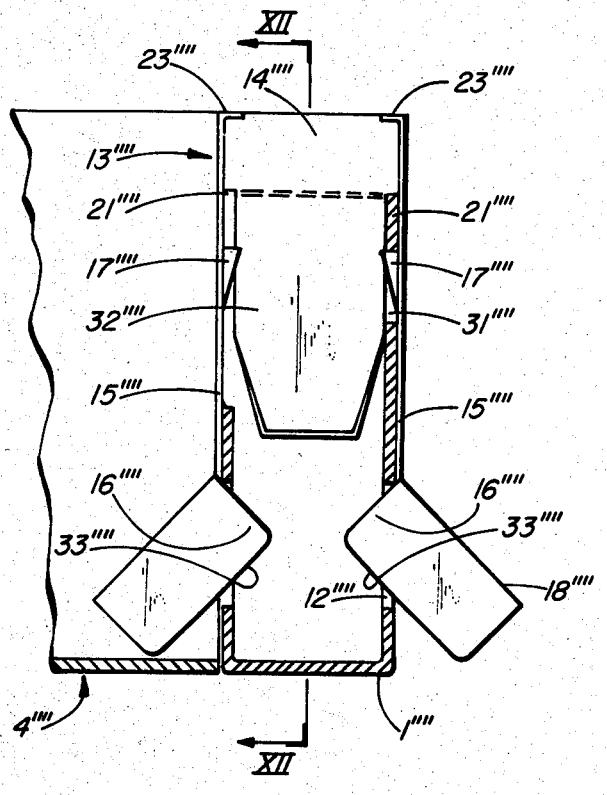
FIG. 9 shows a fifth clip which is another embodiment of the invention, also showing sections through part of a hanger runner and ceiling member.
Figure 10:
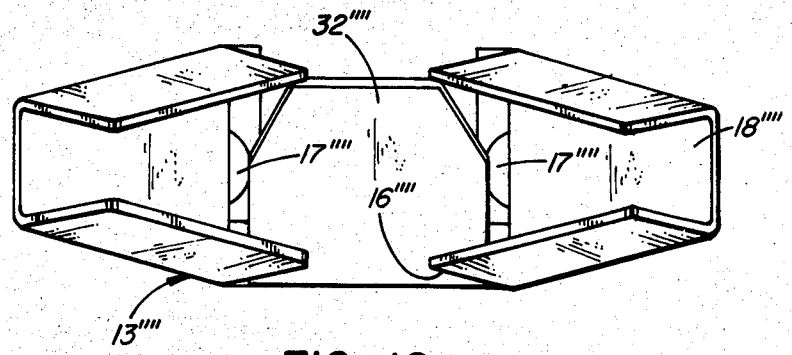
FIG. 10 is a bottom view of the clip of FIG. 9.
Figure 11:
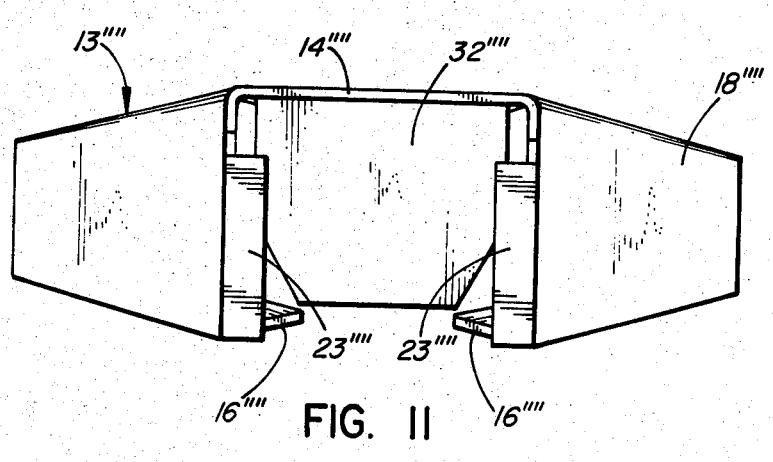
FIG. 11 is a top view of the clip of FIG. 9.
Figure 12:
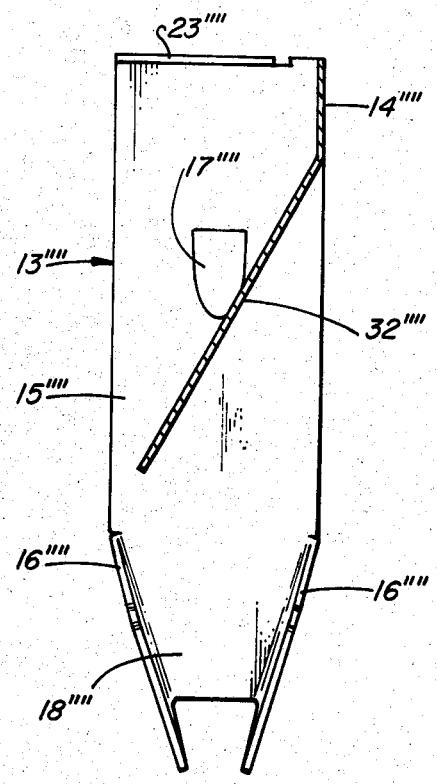
FIG. 12 is a section along the line XII—XII of FIG. 9.
Figure 13:
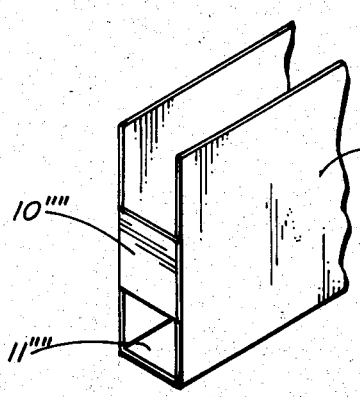
FIG. 13 is a schematic, isometric view of the end of a panel ceiling member.

In FIG. 9, the panel 3 and corresponding runner 9'''' are not shown, but when the panel is inserted up into position, it will spring back the wings 18'''' by camming out their bottom surface, and will then latch into position. To withdraw the panel 3, the panel 3 can be pulled straight down, camming back the detent portions 16''''.

Sixth clip

Figure 14:
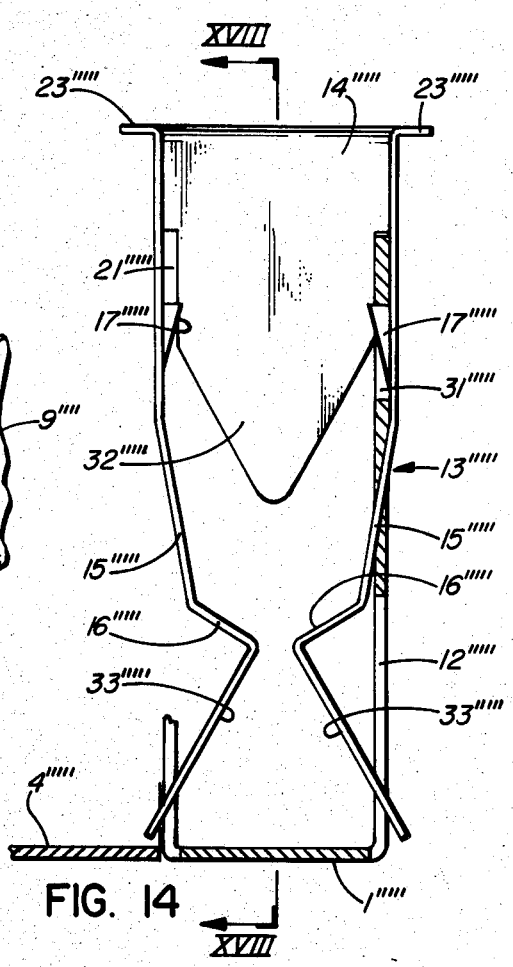
FIG. 14 shows a sixth clip which is another embodiment of the invention, in end view.
Figure 15:
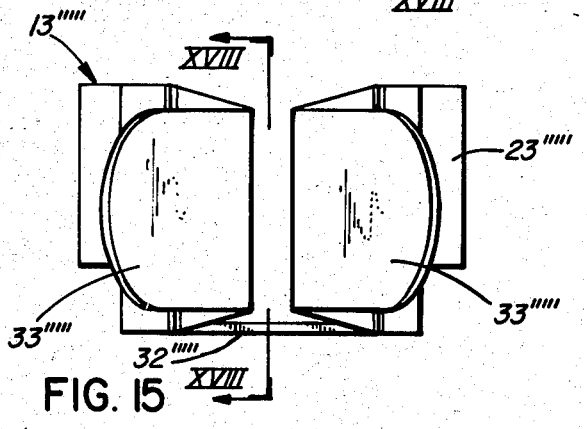
FIG. 15 is a bottom view of the clip of FIG. 14.
Figure 16:
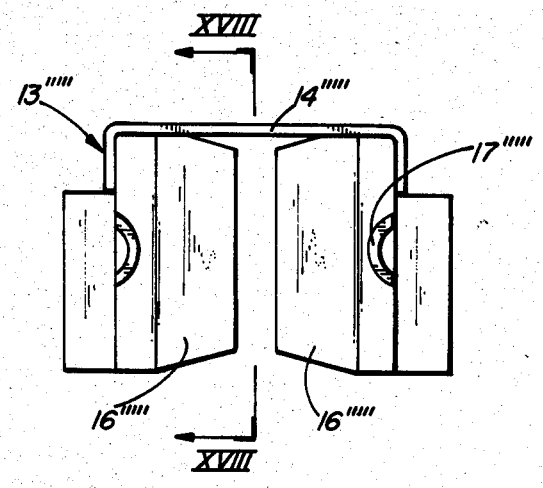
FIG. 16 is a top view of the clip of FIG. 14.
Figure 17:
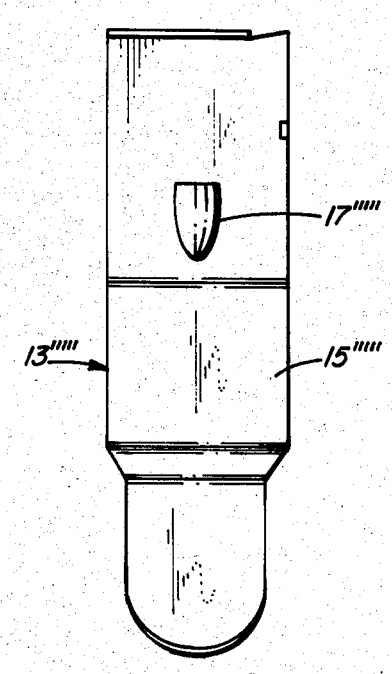
FIG. 17 is an elevation of the clip of FIG. 14.
Figure 18:
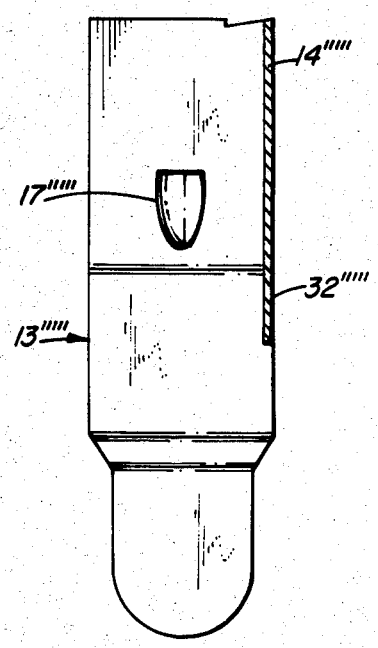
FIG. 18 is a section along the line XVIII—XVIII shown in FIGS. 14, 15 and 16.

The sixth clip 13'''' is a simplification of the fifth clip''''. The jaws 15''''' have detent portions 16''''' and camming surfaces 33''''' formed by simple bends, namely a 10° bend just below the securing portions 17''''' and a 50° bend where the detent portions 16''''' begin. In practice, the jaws 15''''' will be only in the position shown in FIG. 14 before the clip 13''''' is used. When the clip 13''''' is inserted over the hanger runner 1''''', the jaws 15''''' will be pushed slightly outwards as the detent recesses 12''''' only extend up as far as the region of the top of the detent portion 16''''' which this provides some pre-loading on the jaws 15'''''. In an alternative arrangement, the detent recesses 12''''' could extend right up to the level of the first bend in the jaws 15''''', thus allowing the jaws 15''''' to remain in the configuration of FIG. 14 when the clip 13''''' is put on the hanger runner 1'''''.

The blade 32''''' is coplanar with the bridge portion 14''''', and the upper edges 23''''' are turned outwards.

In each case, the runners 1'''' or 1''''' can have a height of 35 mm, the clips 13'''', 13''''' being dimensioned accordingly.

I claim:

1. A suspended ceiling formed of a grid of elongated ceiling members with spaces therebetween, said ceiling members having an opening therein defined by margin ceiling members, said margin ceiling members each extending in a longitudinal direction and having spaced-apart upstanding walls;

panel ceiling members extending between said margin ceiling members with ends of said panel ceiling members abutting said walls of said margin ceiling members which face the opening defined by said margin ceiling members, at least one of said panel ceiling members having means on at least one end thereof for engaging a clip;

a clip having bridge portion means for spanning the space between said spaced-apart upstanding walls of one of said margin ceiling members;

means on said bridge portion means for limiting movement of said clip along the spaced-apart upstanding walls of said ceiling margin member in a direction perpendicular to the longitudinal direction of said margin ceiling member;

a pair of retaining portions, extending from said bridge portion means, for fitting along said spaced-apart upstanding walls of said margin ceiling member, at least one of said retaining portions having first detent means for removably securing said clip engaging means of one of said panel ceiling members to thereby hold said panel ceiling member against said margin ceiling member, said at least one of said retaining portions being movable and biased towards the other of said retaining portions; and securing means on said clip for removably engaging second detent means on said margin ceiling member and for preventing movement of said clip with respect to said margin ceiling member.

2. The suspended ceiling and clip of claim 1, wherein said bridge portion means extends between said pair of retaining portions and said securing means comprises a tab extending from at least one of said retaining portions.

3. The suspended ceiling and clip of claim 2, wherein said means for limiting movement of said clip along the spaced-apart upstanding walls of the margin ceiling member comprises slots between said retaining portions and said bridge portion means.

4. The suspended ceiling and clip of claim 1, wherein said retaining portions comprise two flat extensions connected to said bridge portion means and said first detent means comprises a bend in at least one of said two flat extensions.

5. The suspended ceiling and clip of claim 1, wherein said bridge portion means includes a pair of spaced, parallel vertical pieces connected by a horizontal connecting piece, said vertical pieces extending transversely with respect to the upstanding spaced-apart upstanding walls of the margin ceiling member.

6. The suspended ceiling and clip of claim 5, wherein said means for limiting movement of said clip along the spaced-apart upstanding walls of the margin ceiling member comprises slots in at least one of said vertical pieces which are adapted to receive the upstanding spaced-apart walls of the margin ceiling member.

7. The suspended ceiling and clip of claim 5, wherein said securing means comprises a notch in an upper edge of at least one of said vertical pieces adapted to engage the second detent means on the margin ceiling member.

8. The suspended ceiling and clip of claim 5, further comprising releasing means extending from said at least one of said retaining portions having said first detent means for releasing said first detent means from engagement with the clip engaging means of the panel ceiling member.

9. The suspended ceiling and clip of claim 8, wherein said first detent means is a tab extending from said at least one of said retaining portions, the clip engaging means is a hole in an end plate on the panel ceiling member and the margin ceiling member has a corresponding hole in the upstanding wall abutting the end of the panel ceiling member for receipt of said tab.

10. The suspended ceiling and clip of claim 1, wherein means for limiting movement of said clip along the spaced-apart upstanding walls of the margin ceiling member comprises at least one tab extending from at least one of said retaining portions, each said tab and said retaining portion forming a slot therebetween which receives the spaced-apart upstanding walls of a margin ceiling member.

11. The suspended ceiling and clip of claim 10, wherein said securing means comprises an additional tab extending from said at least one of said retaining portions adapted to be received in an opening in an upstanding wall of the margin ceiling member.

12. The suspended ceiling and clip of claim 1, wherein said pair of retaining portions are parallel spaced-apart flat pieces, said first detent means comprises at least one channel-shaped member, each channel-shaped member being connected to an end of one of said spaced-apart flat pieces.

* * * * *